United States Patent [19]

Güell

[11] Patent Number: 4,819,456

[45] Date of Patent: Apr. 11, 1989

[54] NEEDLE WRAPPING DEVICE FOR CIRCULAR KNITTING MACHINE

[75] Inventor: José M. D. Güell, Barcelona, Spain

[73] Assignee: Jumberca, S.A., Barcelona, Spain

[21] Appl. No.: 61,033

[22] Filed: Jun. 12, 1987

Related U.S. Application Data

[63] Continuation of Ser. No. 802,334, Nov. 26, 1985, abandoned.

[30] Foreign Application Priority Data

Nov. 28, 1984 [ES] Spain ..... 538047

[51] Int. Cl.[4] ..... D04B 9/32

[52] U.S. Cl. ..... 66/135

[58] Field of Search ..... 66/26, 135

[56] References Cited

U.S. PATENT DOCUMENTS

| | | | |
|---|---|---|---|
| 2,189,275 | 2/1940 | Agulnek | 66/135 |
| 2,302,946 | 11/1942 | Holmes | 66/135 |
| 2,358,640 | 9/1944 | Holmes | 66/135 |
| 2,637,988 | 5/1953 | Striar | 66/135 |
| 3,530,688 | 9/1970 | Lombardi | 66/135 |
| 4,570,460 | 2/1986 | Sawazaki | 66/135 |

FOREIGN PATENT DOCUMENTS

| | | | |
|---|---|---|---|
| 568130 | 3/1945 | United Kingdom | 66/135 |

OTHER PUBLICATIONS

Title: Warp Insertion on Circular Knitting Machines—New Designing Tool, *Knitting Technique,* vol. 7 (1985), No. 3.

*Primary Examiner*—Wm. Carter Reynolds
*Attorney, Agent, or Firm*—Staas & Halsey

[57] ABSTRACT

A circular knitting machine for introducing one or more independent wrap yarns to selected needles to form walewise effects in a fabric of jersey construction. The introduction is effected by yarn wrapper assemblies, each comprising a slidable, first member adapted for a radial movement relative to the circular knitting machine and a rotatable, second member pivotably mounted to the first member and having a yarn guide element. The first and second members of the yarn wrapper assembly are imparted with independent but simultaneous, synchronized movement whereby an individual yarn is introduced by the yarn guide element into the hooks of selectively raised needles in a non-circular arcuate path.

19 Claims, 14 Drawing Sheets

C-1
C-2
C-3
C-4
C-5
C-6
29
29
8 7 6 5 4 3 2 1

89
79
77
75
95
93
79
77
95
93
91
91
75
1 2 3 4 5 6

D
C
B
A
87
81
83
85
1 2 3 4 5 6 7 8

C-1
C-2
C-3
C-4
C-5
C-6
29
73
97
99
101
103
A
B
C
D
1
2
3
4
5
6
7
8

NEEDLE WRAPPING DEVICE FOR CIRCULAR KNITTING MACHINE

This is a continuation of co-pending application Ser. No. 802,334 filed on Nov. 26, 1985, now abandoned.

BACKGROUND 0F THE INVENTION

This invention relates to improvements in circular knitting machines, and more particularly to multi-feed knitting machines comprising a rotary cylinder having a plurality of vertical slots in which needles provided with hooked upper ends are housed. The machines according to the invention introduce one or more independent wrap yarns to selected needles to form walewise effects in a fabric of jersey construction. The wrap yarn so introduced may be received by a single needle selectively raised to a yarn receiving position, to form a walewise pin stripe effect in the fabric; or the wrap yarn may be introduced to one or more needles to form single needle and/or multi-needle wrap effects in one or more courses of the fabric.

DESCRIPTION OF THE RELATED ART

It is known in the art to provide machines and methods for creating such walewise design effects wherein wrap yarns are fed from individual yarn sources to selected needles. For example, there is shown in FIG. 3 of U.S. Pat. No. 3,530,688, a circular knitting machine which incorporates a slidable rack and pinion means for actuating a wrap yarn finger in a circular motion. Where the rack member is radially advanced, the cooperating pinion means and the wrap yarn finger associated therewith are rotated in a circular counter-clockwise direction, thereby introducing a wrap yarn into the hooks of selected needles which are raised to a yarn receiving position within the circular arc of swing of the wrap finger. Where the rack member is retracted, the wrap yarn finger is rotated in a clockwise direction, and the wrap yarn is again introduced into the hooks of selected needles which are raised to a wrap yarn receiving position within the circular arc of swing of the wrap yarn finger.

There is also shown in FIG. 1 of Great Britain Pat. No. 2,058,849, cam means external of the circle of needles for actuating wrap elements in a circular path counter-clockwise in substantially a "domino-like" manner to effect the wrapping of successive yarns around selected needles. After engagement between the cam means and the wrap finger is completed, spring means may be used to return each of the wrap fingers in a circular clockwise direction to an inoperative position inwardly of the circle of needles.

U.S. Pat. No. 2,189,275 illustrates a further system for introducing one or more independent wrap yarns into the hooks of selected needles. As shown in FIGS. 1, 4, 5, 6 and 7, a wrap finger, which is slidably guided for radial movement in a slotted dial member, has, as its forward end, a pivoted yarn feeding member (FIG. 7) held in position by spring means. When the wrap finger is radially advanced by cam means shown in FIGS. 5, 6 and 7, a yarn tube is in the path of external cam means mounted for relative movement therewith. Consequently, when the yarn tube is engaged by an external cam, the yarn tube and its associated wrap yarn is swung counter-clockwise in a circular path around and into the hooks of selected needles. When the yarn tube passes out of engagement with the external cam, spring means (FIG. 7) snaps the yarn feeding member clockwise to its initial inoperative position.

Although wrapping techniques as noted above have been effective generally, it has been found that the current emphasis in the knitting industry on greater machine speeds coupled with an increased number of feeds have created a need for more sophisticated and more positive wrapping approaches. More specifically, with respect to increased machine speeds, it has been found that the use of springs for actuating the wrap fingers in one direction represents a potential shortcoming due to the fatigue factor which develops in the spring because of extended machine operation.

It has also been found that external cam means for actuating wrapping elements has created difficulties. That is, the greater the rotational speed of the machine, the greater the force of impact between the external cam means and the wrapping elements it strikes.

In addition, it has been found that when the number of feeds on a circular knitting machine is increased, the circumferential distance between adjacent ground feeds is appreciably lessened, thereby making it of critical importance that the wrapping action be greatly accelerated so as to complete its function in a shorter interval of time and circumferential distance. In other words, the yarn wrapper must rapidly introduce the wrap yarn into the hooks of selected needles and just as rapidly move back out of operation so as not to interfere with ground feeds adjacent to the wrapping area.

SUMMARY OF THE INVENTION

The requirements of present day high-speed, high-feed knitting have created the need for more sophisticated and more positive techniques for introducing wrap yarns.

Accordingly, it is a primary object of the present invention to provide an improved type of knitting machine whereby a plurality of wrap yarns may be efficiently and effectively incorporated walewise into a fabric of circular knit construction.

It is a further object of the present invention to provide a circular knitting machine having the foregoing features which achieves a yarn wrapping function faster and more effectively within a shorter moving distance than heretofore possible.

Yet a further object of the invention is to provide a circular knitting machine of the above type that provides a smoother movement of the yarn wrapping finger movement to the selected needles.

It is yet a further object of the invention to provide a circular knitting machine of the above type which is more versatile and simpler in construction than the conventional knitting machines.

The foregoing objectives are met in the present invention by providing a circular knitting machine comprising: a plurality of needles; a cylinder slotted to receive the plurality of needles; means for actuating the plurality of needles; yarn wrapper assembly means for introducing yarn into the hooks of selected,needles, the wrapper assembly means including a first slidable member adapted for radial movement relative to the cylinder, and a second rotatable member pivotably mounted to the first member and having yarn feeding means at an outer extremity thereon; and means for actuating the first and second members to impart simultaneous movement thereto whereby an individual yarn is introduced into the hooks of selected needles.

More particularly, there is provided a circular knitting machine of the type described above which includes a plurality of yarn wrapper assemblies for introducing a plurality of independent yarns into hooks of selected needles to produce a walewise effect in a fabric.

According to one embodiment of the invention, the circular knitting machine comprises a cylinder with vertical slots to receive the plurality of needles moveable with respect to the slots and two dial members mounted inwardly of the cylinder with one dial member superimposed above the other. The first dial member is rotatable and has a plurality of radial slots. The second dial member is stationary and provided with an inner cam raceway and an outer cam raceway. The first slidable member is adapted to be guided for movement in a cooperating radial slot of the first dial member for radial movement relative to the cylinder.

In the preferred embodiment, the independent means for actuating the first and second members of the yarn wrapper assembly comprises continuous closed track camming means for synchronous operation of the first slidable member and the second rotatable member. The camming means has continuous, unbroken cam surfaces in the same camplate with a first camming system for independently actuating the first slidable member between inner and outer radial positions and a second camming system for independently actuating the second rotatable member between different rotatable positions. The first slidable member comprises an elongated member having a rectangular cross-section, smooth wall surfaces for slidable engagement with wall surfaces of the cooperating radial slot of the first dial member, a downwardly extending cam follower member for cooperating with the continuous, unbroken cam surface of the first camming system thereby actuating the first slidable member between inward and outward radial positions, and a slot formed at the forward end for receiving and pivotally mounting the second rotatable member for rotational movement. The second member comprises an elongated member having a downwardly extending cam follower member lying in substantially the same plane as the cam follower member of the first slidable member for cooperating with the continuous, unbroken cam surface of the second camming system thereby imparting a rotational movement to the second member and a downwardly extending yarn tube member of the yarn feeding means.

More particularly, the simultaneous movement of the first slidable member and the second rotatable member is such to provide a noncircular arcuate path wherein the yarn feeding means commences from a start position inwardly of the needles, continuing in the arcuate path inwardly of the needles, cutting across the circle of needles, then moving through an arcuate path outwardly of the needles for introducing the yarn into the hooks of the selectively raised needles and than again cutting across the circle of needles back to the start position.

The present invention also contemplates a circular knitting machine incorporating striping means for use during certain stages of machine operation. When such striping means is included, the first inner and second outer camming systems cooperate to maintain each wrap assembly inactive so that the forward yarn introducing end of the second rotatable member is in an inoperative position inwardly of the circle of needles during those periods of machine operation when relative movement exists between the striping means and each of the wrapper assemblies. To such end, according to the invention, each of the camming systems is provided with an inwardly extending portion well removed from the outermost edge of the second dial member, such that when the cam follower members are respectively on those portions, the wrapper assembly to which the cam follower members belong remains inoperative.

In the detailed embodiment of the invention, the rotatable member of the yarn wrapper assembly is generally L-shaped having arms of unequal length. The cam follower member of the rotatable member is substantially at the end of the short arm of the L. The yarn feeding means is a tube located substantially at the end of the long arm of the L. The long arm has a sloping center portion and there is a hole in the apx of the L for the passage of a pin for attachment with the first slidable member.

BRIEF DESCRIPTION OF THE DRAWINGS

The accompanying drawings, which are incorporated in and constitute a part of the specification, illustrate embodiments of the invention and, together with the written description, serve to explain the principles of the invention.

DESCRIPTION OF THE PREFERRED EMBODIMENTS OF THE INVENTION

Reference will now be made in detail to the present, preferred embodiments of the invention, examples of which are illustrated in the accompanying drawings.

Figure 1:
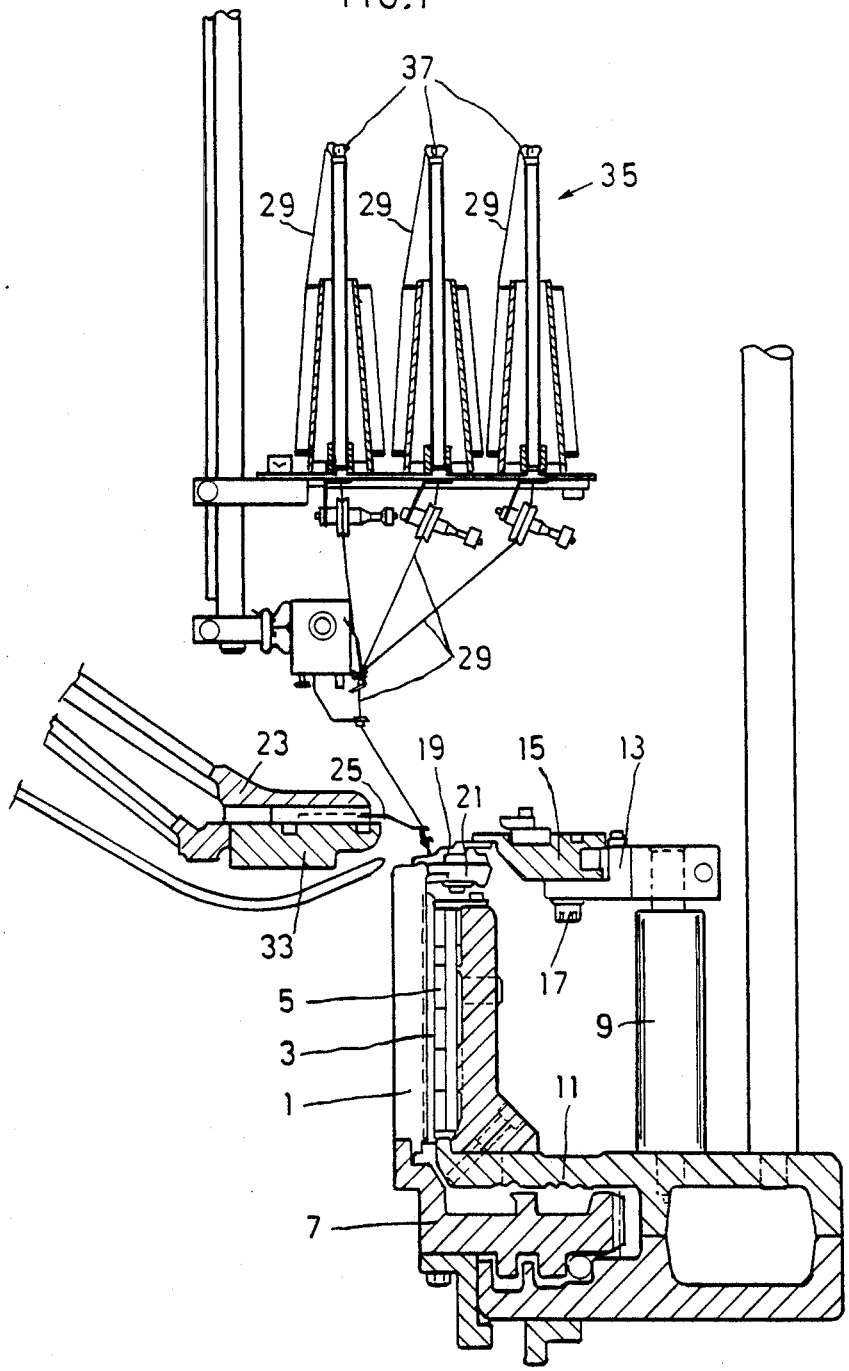
FIG. 1 is a vertical view, partly in section, of a portion of a circular knitting machine of the present invention.
Figure 2:
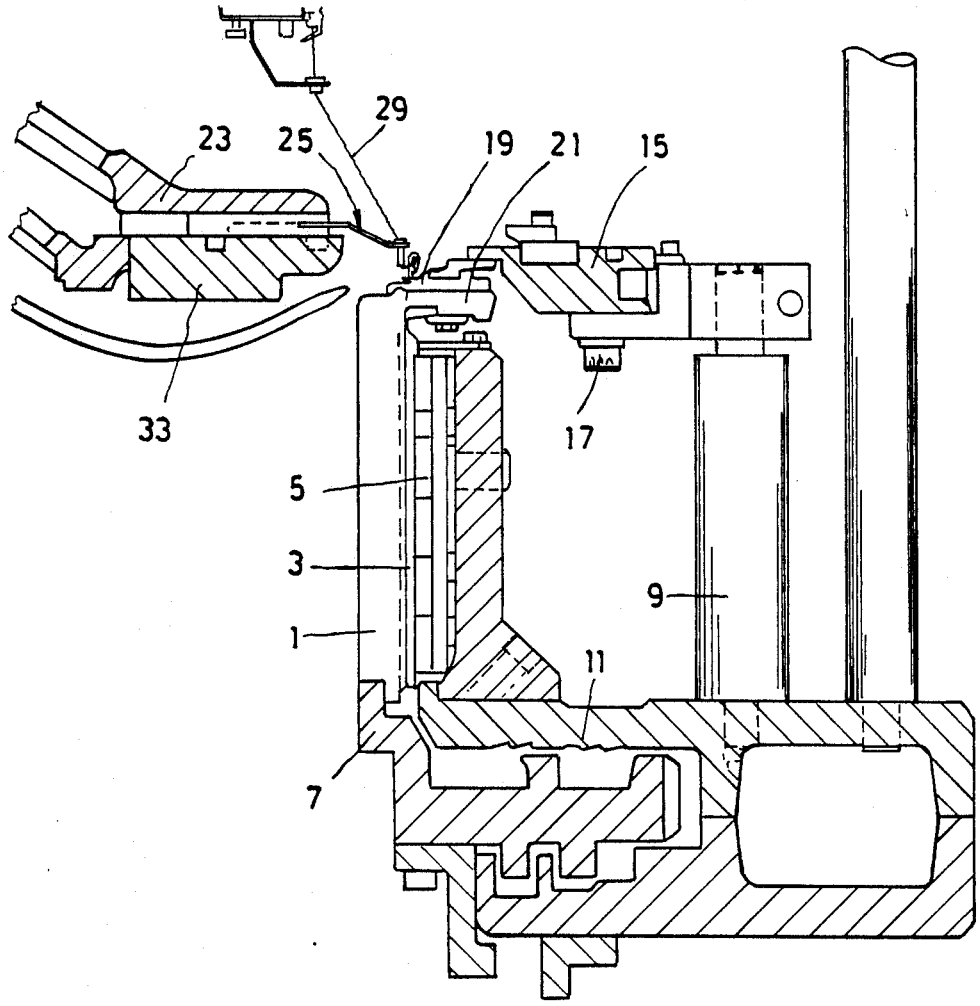
FIG. 2 is an enlarged, vertical view, partly in section, of the knitting machine of FIG. 1, illustrating in particular the cylinder assembly and a portion of the yarn wrap assembly.

There is shown in FIG. 1 and FIG. 2 a vertical sectional view of a portion of a circular knitting machine of the present invention. The knitting machine has a cylinder assembly which comprises a rotating cylinder 1 vertically slotted to receive a plurality of needles 3 and actuated by a stationary cam means 5 in a conventional way. Cylinder 1 is fixedly mounted on ring gear member 7 which is driven by conventional gear means (not shown). Post 9, mounted on stationary bedplate 11, supports at its upper end sinker cam support ring 13 on which a sinker dial cam ring 15 is fixed by screw means 17.

Sinker elements 19 are guided for radial movement in their respective slots in sinker dial 21 which is secured to the cylinder 1 by conventional means. Sinkers 19 and needles 3 are actuated in a synchronous relationship in a manner well known in the art.

A first rotatable dial member 23 is mounted inwardly of cylinder 1, and geared to turn simultaneously with it by dogless gear means (not shown). The first, rotatable dial member 23 is radially slotted to receive a plurality of wrapper yarn subassemblies 25. Dial member 23 rotates at the same speed as the needle cylinder. Yarn wrapper assembly means for introducing yarn into the hooks of selected needles includes wrapper subassembly 25 as seen more clearly in FIGS. 3 and 4 which has at its forward or outer extremity end a yarn feeding means, preferably in the form of a downwardly extending yarn tube 27. The wrapper subassembly 25 is actuated in an arcuate path whereby a wrap yarn 29 is fed into the hooks 3 of one or more needles selectively positioned to a yarn receiving level.

To actuate the wrapper subassemblies 25, stationary camplate 33 is provided with inner and outer camming means as will hereinafter be described. The dial member 23 is superimposed over the camplate 33.

Yarn wrapper assembly means further includes, as best shown in FIG. 1, a wrap yarn subassembly 35 positioned above the dial member 23 and the cylinder 1 and mounted to rotate therewith in a fixed relationship by conventional means (not shown). The wrap yarn subassembly 35 includes hollow yarn posts 37 coinciding with the number of wrapper subassemblies 25 mounted in the machine. Wrap yarns 29 are guided from their respective yarn packages down through the hollow yarn posts 37, through the yarn tubes 27 and subsequently into the hooks 31 of selected needles.

Figure 3:
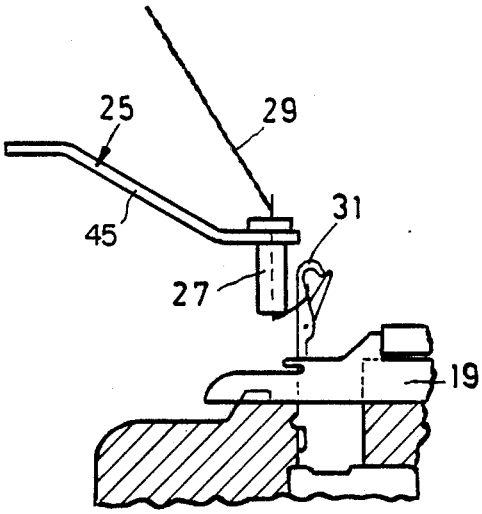
FIG. 3 is an enlarged, sectional view of a portion of the machine of FIG. 2 depicting the yarn wrapping element in a position inwardly of the circle of needles.

There is illustrated in FIG. 3, a portion of the wrapper subassembly 25 wherein the downwardly extending yarn tube 27 is positioned inwardly of the hook 31 of a needle of the circle of needles.

Figure 4:
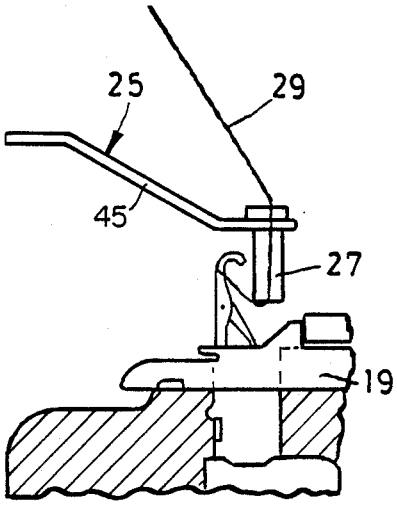
FIG. 4 is an enlarged, sectional view of a portion of the machine of FIG. 2 illustrating the yarn wrapping element in a position outwardly of the circle of needles.

In FIG. 4, the yarn tube 27 is shown outwardly of the hook 31 of a needle selectively positioned to a yarn receiving level. During all phases of machine operation, the two components which comprise each yarn wrapper subassembly element 25 are independently operable by inner and outer camming means of camplate 33 as will hereinafter be fully described.

More particularly, each of the yarn wrapper subassemblies 25 includes a first member or component 39 adapted for radial movement relative to the cylinder 1, and a second rotatable member or component 45 pivotally mounted to the first slidable member 39 and having the yarn feeding means comprising the yarn tube 27 at an outer extremity thereon.

Figure 6:
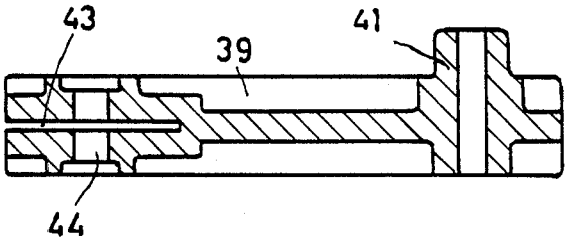
FIG. 6 is a sectional view of the first slidable member taken along the line VI—VI in FIG. 5.
Figure 5:
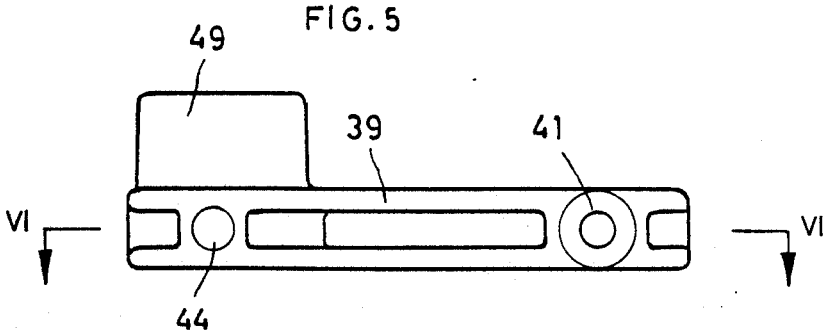
FIG. 5 is a bottom view of the first slidable member of the yarn wrapper assembly means.
Figure 6A:
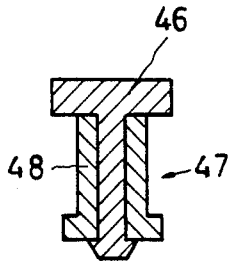
FIG. 6*a* is an enlarged, axial sectional view of the pin means pivotal mounting the second member to the first member of the yarn wrapper assembly means.
Figure 9:
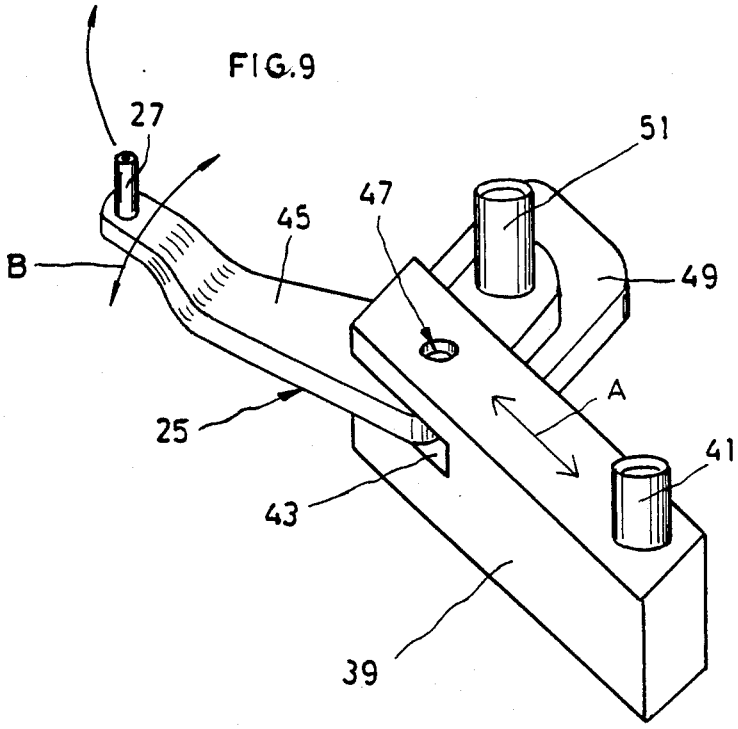
FIG. 9 is an isometric, bottom view of the yarn wrapper assembly means comprising the first slidable member shown in FIGS. 5 and 6 and the second rotatable member shown in FIGS. 7 and 8.

FIG. 5 is a bottom view of the first, slidable component 39 of wrapper subassembly 25, and FIG. 6 is a side view of the same component 39. Member 39 is preferably made of plastic, such as nylon. Member 39 is also illustrated in FIG. 9. At the rearward portion of the first component 39, and integral therewith, is a projection or cam follower member 41 which extends into the inner raceway of camplate 33 and cooperates therewith to effect actuation of the slidable component 39 between inner and outer radial positions. As seen more clearly in FIGS. 6 and 9, the forward end of the slidable component 39 has a slot 43 to receive the rotatable second component 45, pivotably mounted through pin means 47 as shown in FIGS. 6*a* and 9. A flange 49 is provided for additional support for the rotatable second component 45. Transversely to the slot 43, there is disposed a reamed hole 44 to receive the pin means 47 and achieve the pivotable mounting of the member 45 to member 39. As seen from FIG. 6*a*, the pin means preferably comprises a male member 46 passing through the bore in a female member 48, the end of member 46 being rolled or otherwise closed off.

Figure 8:
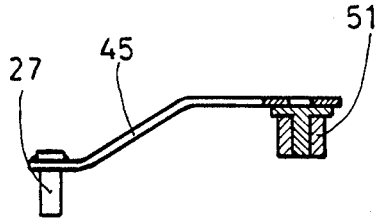
FIG. 8 is a sectional view of the second rotatable member taken long the line VIII—VIII of FIG. 7.
Figure 7:
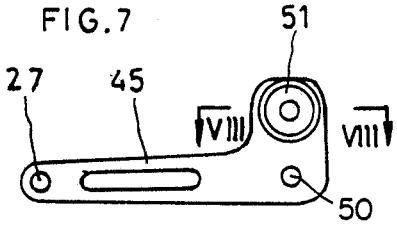
FIG. 7 is a plan view of the second rotatable member of the yarn wrapper assembly means.

FIG. 7 and FIG. 8 are respective plan and side views of the second rotatable component 45 which is pivotably mounted on slidable component 39. The second rotatable component 45 is provided with a projection or cam follower member 51 for engagement with the independent outer camming means of the camplate 33 as will hereinafter be more fully described. The projection 51 is preferably coated with a sleeve of an appropriate plastics material, such as nylon. The second rotatable component 45 has a generally L-shaped frame, having arms of unequal length. The projection 51 is at the end of the short arm of the L frame whereas the tube 27 is at the end of the long arm. In the apex of the L frame, there is a hole 50 (FIG. 7) for passage of the pin means 47 and the long arm of the L frame is provided with a sloping center portion.

FIG. 9 is an isometric bottom view of the yarn wrapper subassembly 25 comprising the first slidable component 39 and the second rotatable component 45. Projections 51 and 41 are substantially in the same plane and are independently actuated by separate camming means in the camplate 33. The slidable component 39 is moved radially relative to the cylinder between inner and outer positions as indicted by arrow A. The rotatable component 45 is mounted for pivotable movement on the slidable component 39. The rotatable component 45 is actuated by interaction between projection means 51 and the outer camming means of the camplate 33 as will hereinafter be fully described. The independent movements of slidable component 39 and rotatable component 45 are synchronized by the camming means so that the yarn tube member 27 moves in a non-circular but arcuate path around needles selected within the arcuate path. Arrow B is illustrative of this movement.

Figure 10:
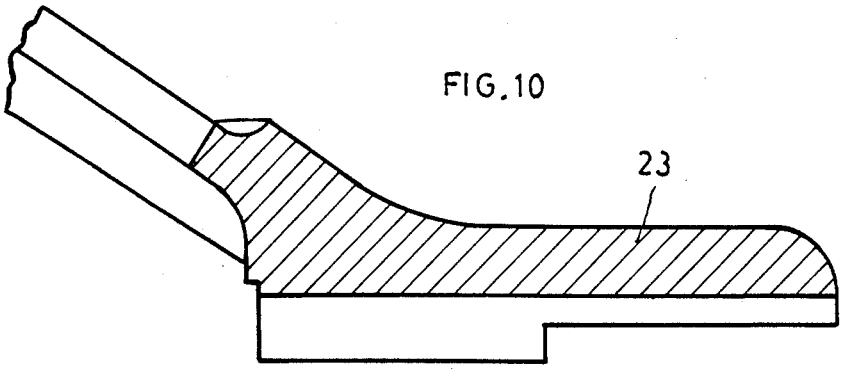
FIG. 10 is a side, sectional view of a first portion of the radially slotted rotatable dial member.
Figure 11:
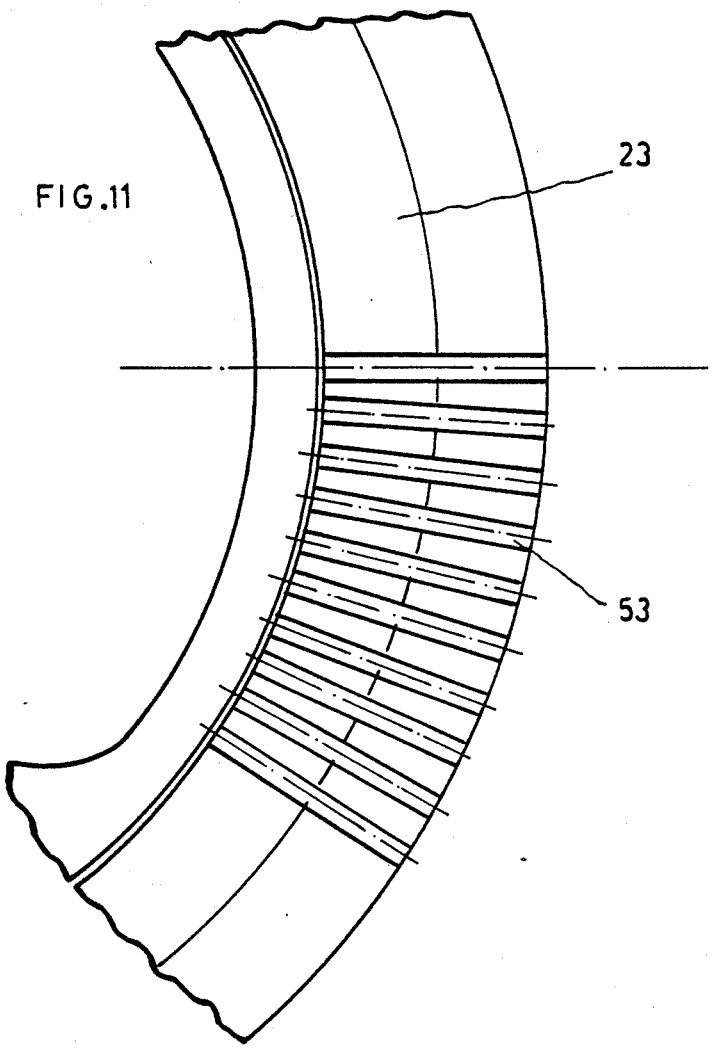
FIG. 11 is a bottom view of a portion of the radially slotted rotatable dial member.

FIGS. 10 and 11 depict the first slotted rotatable inner dial member 23. The dial member 23 has radial slots 53, the number of such radial slots generally corresponding to the number of wrapper subassemblies 25 provided in the machine. It will be understood, of course, that all or merely certain of the radial slots 53 may be fitted with wrapper subassemblies 25 dependent upon styling requirements in the final knitted fabric.

Figure 12:
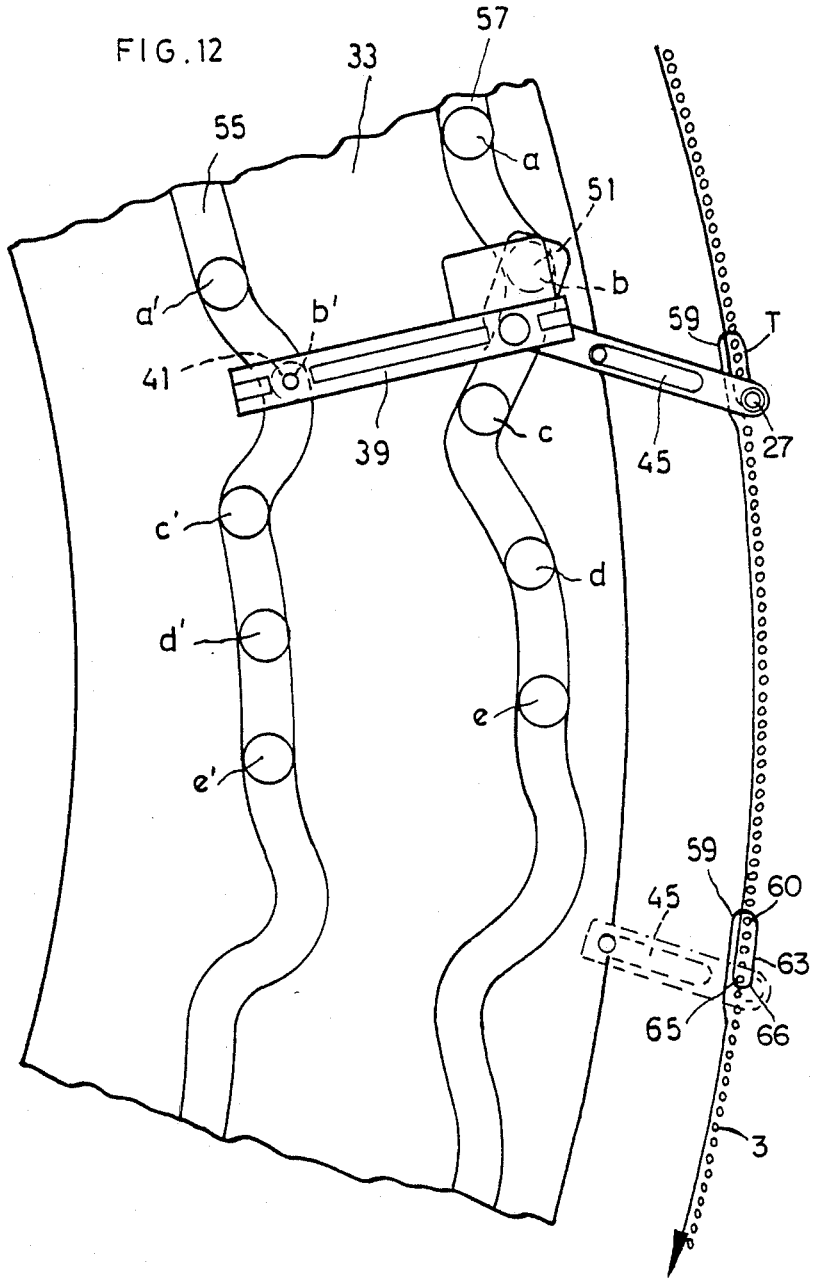
FIG. 12 is a plan view of one operating cycle of a portion of a stationary double raceway camplate to actuate the yarn wrapper assembly means, illustrating a yarn wrapping assembly means guided by the double raceway, a portion of the path of the wrapping finger of the assembly means and a portion of the needle cylinder.

In FIG. 12, there is shown a plan view of one complete operating cycle of a portion of the camplate 33. Inner camming means comprising inner cam raceway 55 of camplate 33 cooperates with projection 41 of the slidable component 39 to impart controlled movement of the component 39 between inner and outer radial positions. Simultaneously, outer camming means comprising an outer cam raceway 57 of camplate 33 cooperates with projection 51 of rotatable member 45 to impart arcuate movement to wrap yarn tube 27. Dual cam raceways 55 and 57 are continuous, unbroken and integral in the same camplate 33 and present smooth, unbroken camming surfaces throughout their extents. The raceways 55 and 57 are precisely and independently positioned relative to each other and are synchronized in operation so that as slidable member 39 is actuated radially by camming raceway 55, rotatable member 45 is precisely rotated through the interaction of projection 51 and camming raceway 57. Consequently, as projection 41 of slidable member 39 cooperates with camming means 55, which moves relative thereto to impart radial movement to the slidable member 39, projection 51 occupies a different and precise circumferential position in raceway 57. This determines the extent and direction of the non-circular, arcuate movement of wrap tube 27. In this regard, in FIG. 12, the relative positions of projections 41 and 51 of wrapper assembly components 39 and 45 are shown in their respective cam raceways. Thus, for example, when projection 41 occupies position a' in raceway 55, projection 51 occupies position a in raceway 57. Successive alphabetical positions are indicated and they illustrate the relative positions of projection 41 and projection 51 in their respective raceways. By the interaction of the independent camming systems, the yarn tube member 27 is moved through a complete non-circular, arcuate path T, commencing from a starting position inwardly of the circle of needles, continuing in its arcuate path inwardly of the circle of needles, cutting across the circle of needles, then moving through an arcuate path outwardly of the needles for introducing the yarn into the hooks of the selectively raised needles and then again, cutting across the circle of needles back to the start position.

Figure 12A:
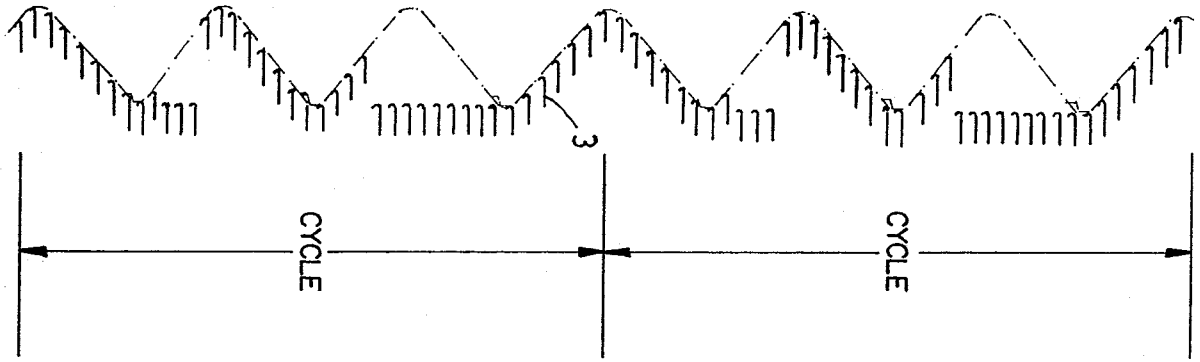
FIG. 12*a* is a vertical, schematic view of the needles corresponding to the operating cycles of the portion of the camplate and yarn wrapper assembly means illustrated in FIG. 12.
Figure 25:
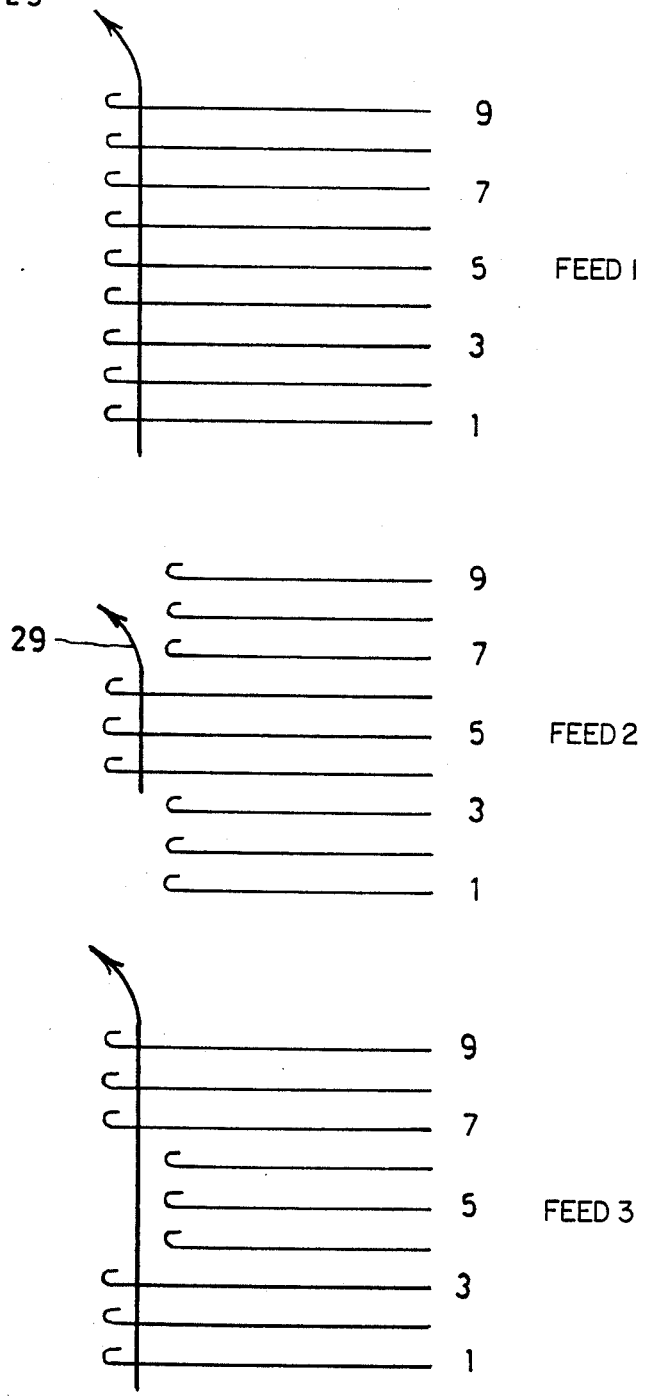
FIG. 25 is a further schematic representation of a complete knitting cycle with three successive feeds wherein a wrap yarn is introduced into the hooks of three selected needles during the second feed.

FIG. 12*a* illustrates the relationship between the yarn wrapper subassembly 25 and the needle positions at each complete knitting cycle comprising three successive feeds. Two of these knitting cycles are depicted in FIG. 12*a*. FIG. 25, as further described hereinafter, schematically depicts this relationship between the needle position and yarn introduction at each of the three successive feeds for the knitting cycle. For example, at feed 1, a jersey course is knitted on all needles; at feed 2, selected needles are raised to a knit level to receive wrap yarn 29; at feed 3, all needles, except those selected at feed 2, are raised to knit height to receive the ground yarn. These three successive feeds together constitute one complete knitting cycle.

Because of the precise relationship between inner cam raceway 55 and outer cam raceway 57, and the continuous, smooth, unbroken cam surfaces of both raceways, the wrapping motion of wrap yarn tube 27 may be acomplished at an extremely high speed within a minimal, non-circular, arc length. This represents a sophisticated and highly effective method to accelerate wrapping action in the new generation of knitting machines which combine both high speeds and increased feeds.

Figure 13:
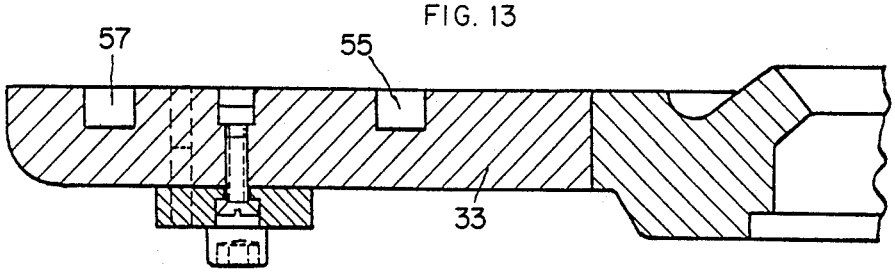
FIG. 13 is a side, sectional view of the camplate, a portion of which is illustrated in FIG. 12.

FIG. 13 is a side sectional view of the stationary camplate 33 depicting inner cam raceway 55 which cooperates with projection 41 of the first slidable member 39 and outer cam raceway 57 which cooperates with projection 51 of the second rotatable member 45.

Figure 14:
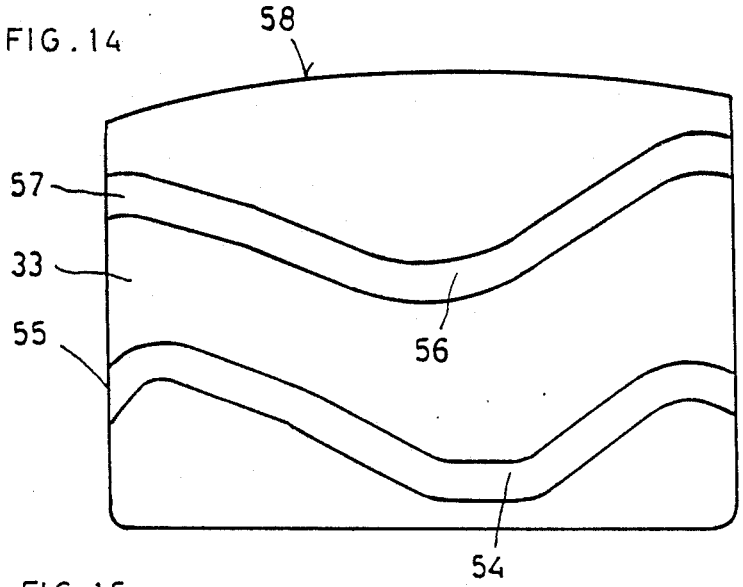
FIG. 14 is a plan view of another portion of the second camplate of FIG. 13, wherein the raceways are provided with inwardly extending portions spaced from the outer edge of the camplate so that the yarn wrapper assembly means are maintained in their inward, inoperative positions during periods when striping means are introduced.

In FIG. 14, inner cam raceway 55 and outer cam raceway 57 are illustrated during another phase of the machine's operation when the wrapper assembly 25 is maintained inoperative in a position inwardly of the circle of needles. This inoperative position is provided so that striping apparatus may be made operable during those periods of machine operation when the wrapper subassemblies 25 must remain out of action. This is attained by the presence of the cam raceway portions 54 and 56 which are spaced back from the outermost edge 58 of the camplate 33. The projections 41 and 51, when in these corresponding cam raceway portions 54 and 56, cause the corresponding wrapping subassembly 25 to remain inside the needle circle.

Figure 15:
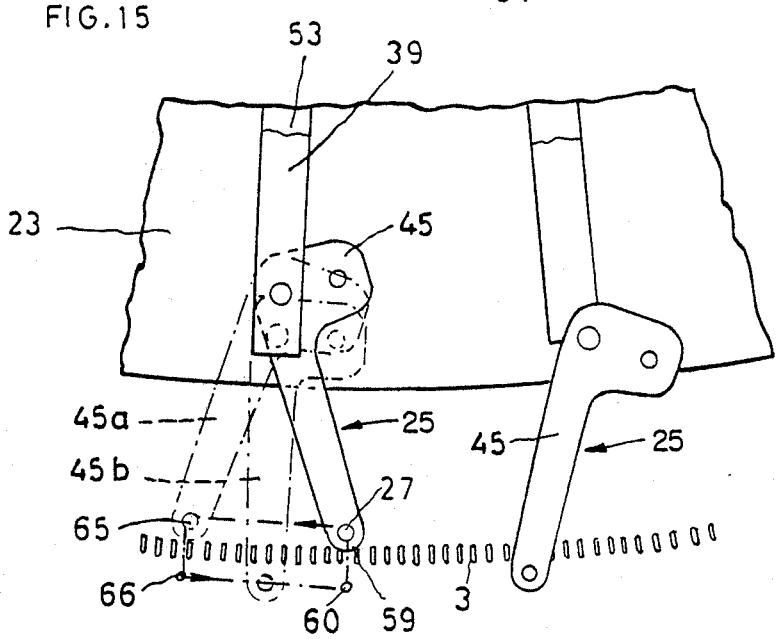
FIG. 15 is a plan view of adjacent yarn wrapper assembly means depicting two positions of the wrapper assembly means and the paths of the yarn tube members relative to the needles, in introducing the wrap yarns into the hooks of selected needles.

In FIG. 15, there is illustrated schematically the wrapping action of two adjacent wrapper subassemblies 25 relative to the needles 3 to be wrapped. As slidable component 39 is radially actuated in slot 53 of dial member 23, the rotatable component 45 is independently actuated so that the forward yarn introducing tube 27 moves in the directions of the arrow from a starting position 59 inwardly of the circle o needles 3, to position 65 also within the circle of needles; the wrap yarn tube 27 covers this path in the space lying between three consecutive machine feeds at a speed slightly faster than that of the needle movement and corresponds to the inoperative zone of the wrapping cycle. Subsequently, the wrap yarn tube 27 crosses in an arcuate path through the needle circle to position 66, where the speed is pratically nil and the needle speed is constant; in progressing from position 66, the wrap yarn tube 27 moves externally of the circle of needles 3 to position 60, recrossing the circle of needles 3 once again to the starting position 59. During this arcuate path of movement, the wrap yarn tube 27 moves completely around and supplies a wrap yarn to selected needles.

In this position 59, the cycle starts again, three feeds ahead of where it had started previously and will be repeated on the same needles.

In FIG. 15, the member 45 of wrapper subassembly 25 shown at the left is provided with a tube 27 in position 59; the member **45*a* of subassembly 25 in dotted lines corresponds to the position in which the tube 27 is in position 65; and the member 45*b* of subassembly 25, also in dotted lines, corresponds to a position of the tube 27 outwardly of the needle circle 3. The member 45 of wrapper assembly 25 shown at the right of FIG. 15 corresponds to the position in which the tube is in position 66, i.e., an intermediate position between those corresponding to members 45*a* and 45*b***.

Figure 16:
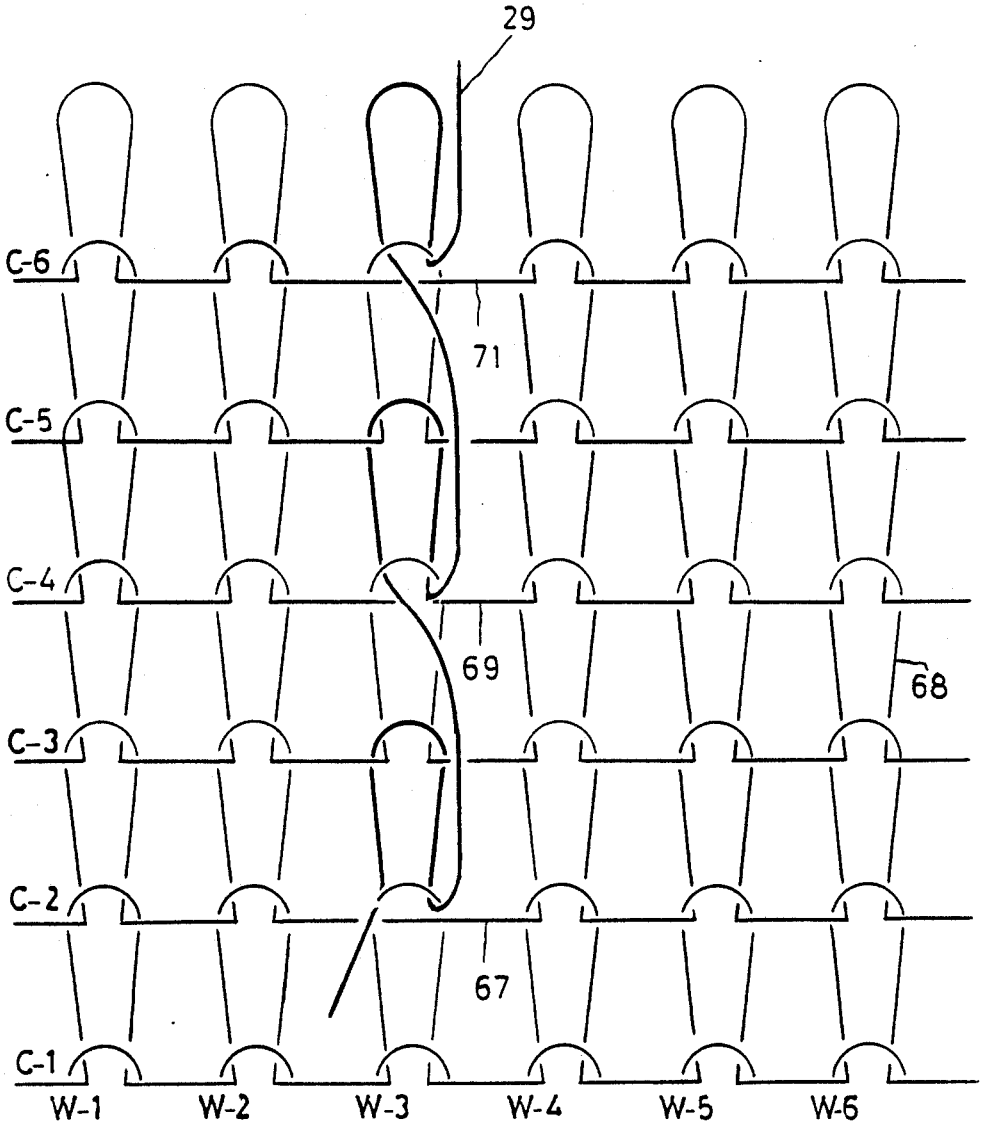
FIG. 16 is a schematic stitch diagram taken from the technical backside of a single jersey fabric showing a wrap yarn knitted walewise in a single needle wale in the practice of the present invention.

FIG. 16 is a schematic stitch diagram of one fabric producible with the machine of the present invention. The fabric is seen from the technical backside. W-1, W-2, etc., represent needle wales, and C-1, C-2, etc. represent courses. The wrap yarn 29 shown in heavy outline is knitted in needle wale W-3 and in alternate courses C-2, C-4 and C-6. It will be noted that the ground yarns 68 are floated at 67, 69 and 71. It will be further observed that the wrap yarn 29 is floated on the backside of the fabric between courses in which the wrap yarn is knitted into the fabric. In this instance, the wrap yarn is knitted in the same needle wale W-3.

Figure 17:
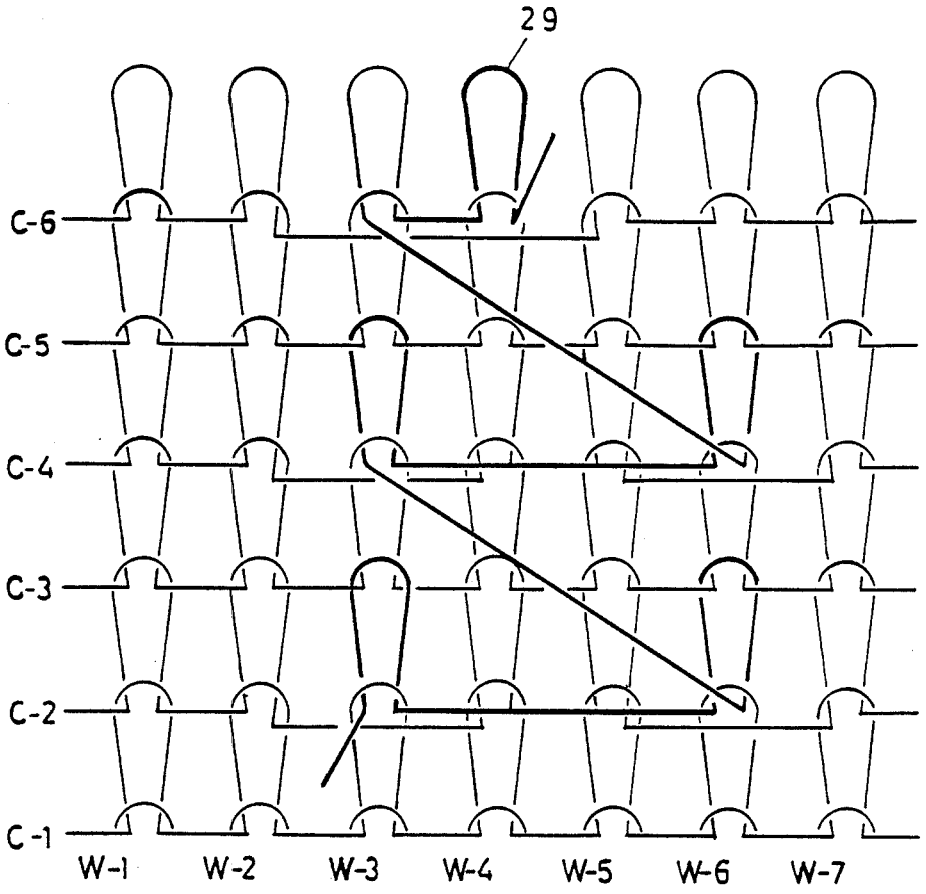
FIG. 17 is a schematic stitch diagram taken from the technical backside of a single jersey fabric in which a wrap yarn is knitted in more than one needle wale.

FIG. 17 is a schematic stitch diagram of a second knitted fabric producible with the machine of the present invention. In this instance, wrap yarn 29 is knitted in more than one needle wale. As shown, the wrap yarn 29 is knitted in needle wale W-3 of course C-2, floated across wales W-4 and W-5 and knitted in needle wale W-6 of the same course C-2. The wrap yarn is then floated across courses C-2 and C-3 and knitted in course C-4 in needles wales W-3 and W-6. The wrap yarn is again floated to course C-6 where it is knitted into the fabric in needles wales W-3 and W-4.

Figure 18:
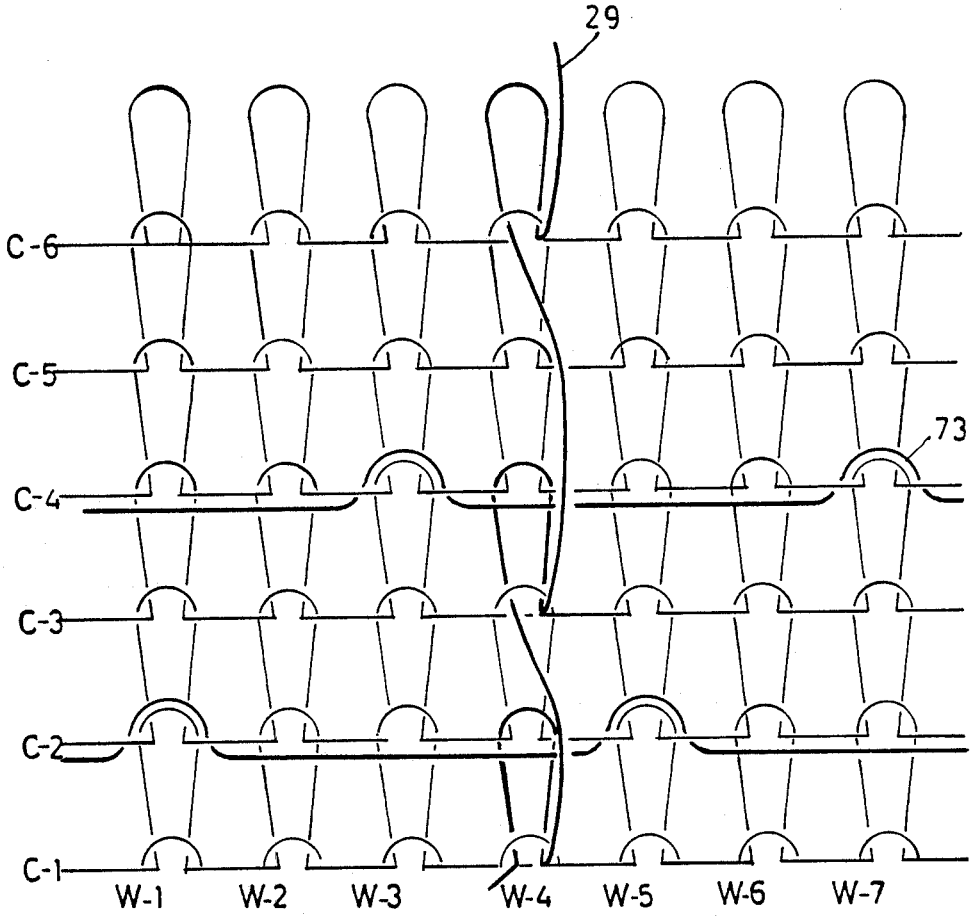
FIG. 18 is a schematic view, similar to FIG. 16, in which a fleece or lay-in yarn is introduced selectively in certain of the courses of the fabric.

In FIG. 18, there is shown a further fabric construction producible with the knitting machine of this invention. It will be noted that wrap yarn 29 is knitted in needle wale W-4 and in courses C-1, C-3, and C-6. In addition to wrap yarn 29, lay-in yarns 73 are selectively caught in the fabric in a non-knit manner in courses C-2 and C-4. During those phases of machine operation when lay-in yarns are selectively introduced into the knitting sequence, the wrapper subassembly 25 is maintained inoperative so that the wrap yarn tube 27 remains inwardly of the circle of needles. To accomplish this, it will be observed in FIG. 14 that cam raceways 55 and 57 are substantially parallel and inwardly of the outermost edge 58. Consequently, as slidable component 39 is urged inwardly by camming means 55, the rotatable component 45, similarly, moves inwardly by camming means 57 without any rotational force being applied thereto.

Figures 19, 20, 21:
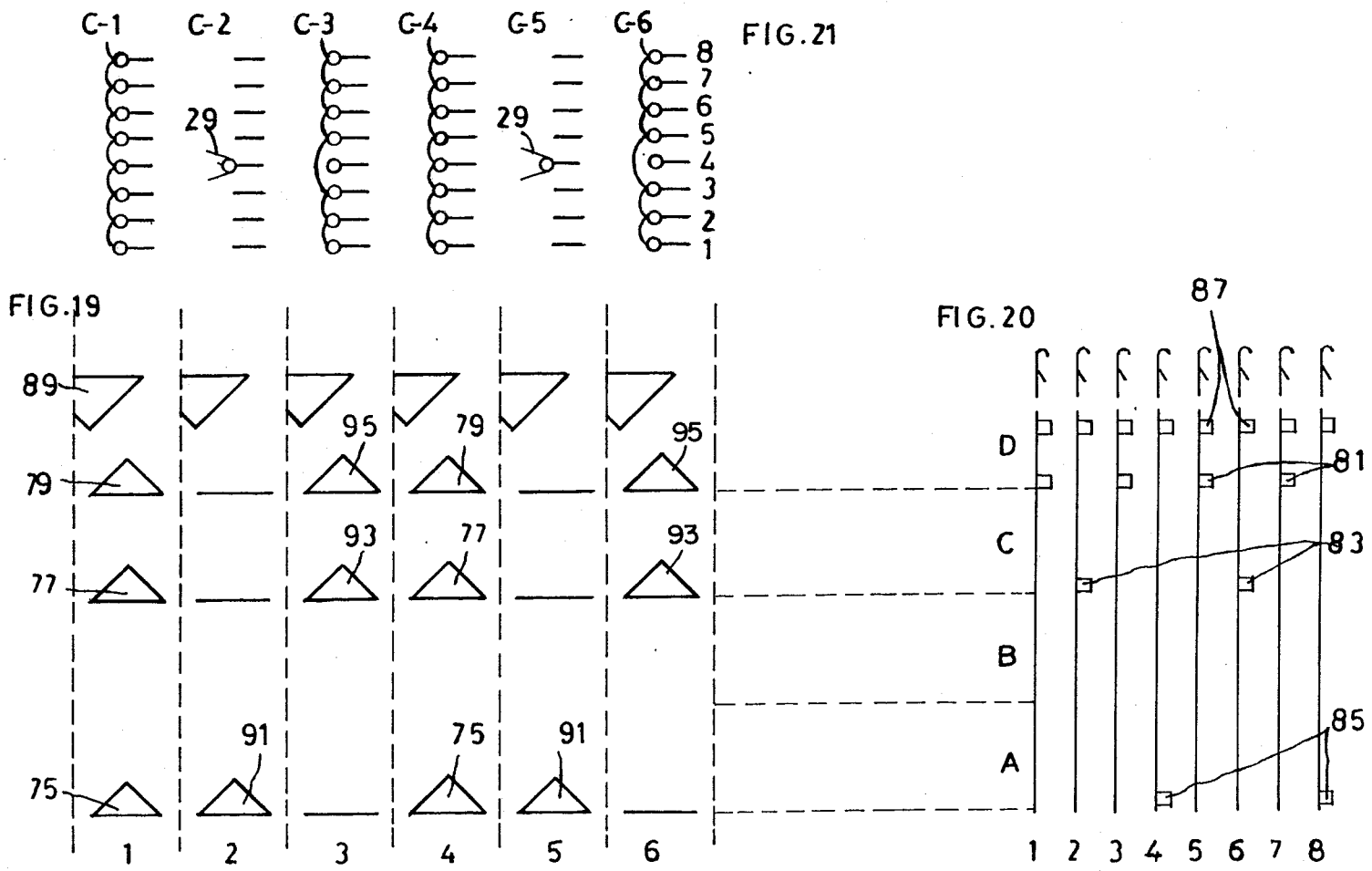
FIG. 19 is a schematic representation illustrating a multi-raceway camming system for two adjacent knitting cycles to effect needle selection in the knitting machine during the practice of the present invention.
FIG. 20 is a schematic representation illustrating needle butt means that may be used in cooperation with the camming system of FIG. 19.
FIG. 21 is a schematic representation of successive fabric courses produced when the camming means of FIG. 19 cooperate with the knitting needle butt means of FIG. 20.

FIGS. 19 and 20 are illustrative of he camming selection and needle butt arrangement of a multi-raceway knitting machine to produce the wrap fabric schematically shown in FIG. 21. In FIG. 19, six successive feeds are indicated. Feeds 1 and 4 as shown, are all jersey feeds; feeds 2 and 5 are wrap feeds; and feeds 3 and 6 are jersey feeds knitted on needles which did not knit a wrap yarn at feeds 2 and 5. It will be further noted that at feeds 1 and 4, cams 75, 77 and 79 occupy levels at A, C, and D. These cams separately cooperate with needle butts which occupy these respective levels. For example, cam 79 in level D as seen in FIGS. 19 and 20, actuates needles whose selective butts occupy the same level D. Butts 81 occupy level D, and consequently, their respective needles 1, 3, 5, 7, etc., will be raised to a knit level by cam 79. Similarly, cam 77 at level C will actuate needles 2 and 6 with butts 83. Finally, cam 75 at level A will actuate needles 4 and 8 with butts 85. It will be seen that at feed 1 in FIG. 19, cams 75, 77 and 79 occupy levels A, C, D and that all needles 1, 2, 3, 4, etc., as seen in FIG. 20 have butts 81, 83 and 85 at these same levels. Consequently, at feed 1 all needles are raised to a knit level to produce the jersey course C-1 shown in FIG. 21. It will be understood that all needles have a common butt 87 and that these are acted upon by identical stitch cams 89 associated with each feed.

At feeds 2 and 5 in FIG. 19, raising cams 91 occupy level A and these cams 91 raise needles 4 and 8 whose butts 85 are at the same level A. Consequently, needles 4 and 8 alone are raised to a knit height to receive the wrap yarn. Therefore, the wrap yarn 29 is knitted into the fabric as indicated in FIG. 21 at courses C-2 and C-5.

It will be similarly undersood that cams 93 and 95 at feeds 3 and 6, occupying levels C and D, will cooperate with needles having butts 81 and 83 at the same level.

Figures 22, 23, 24:
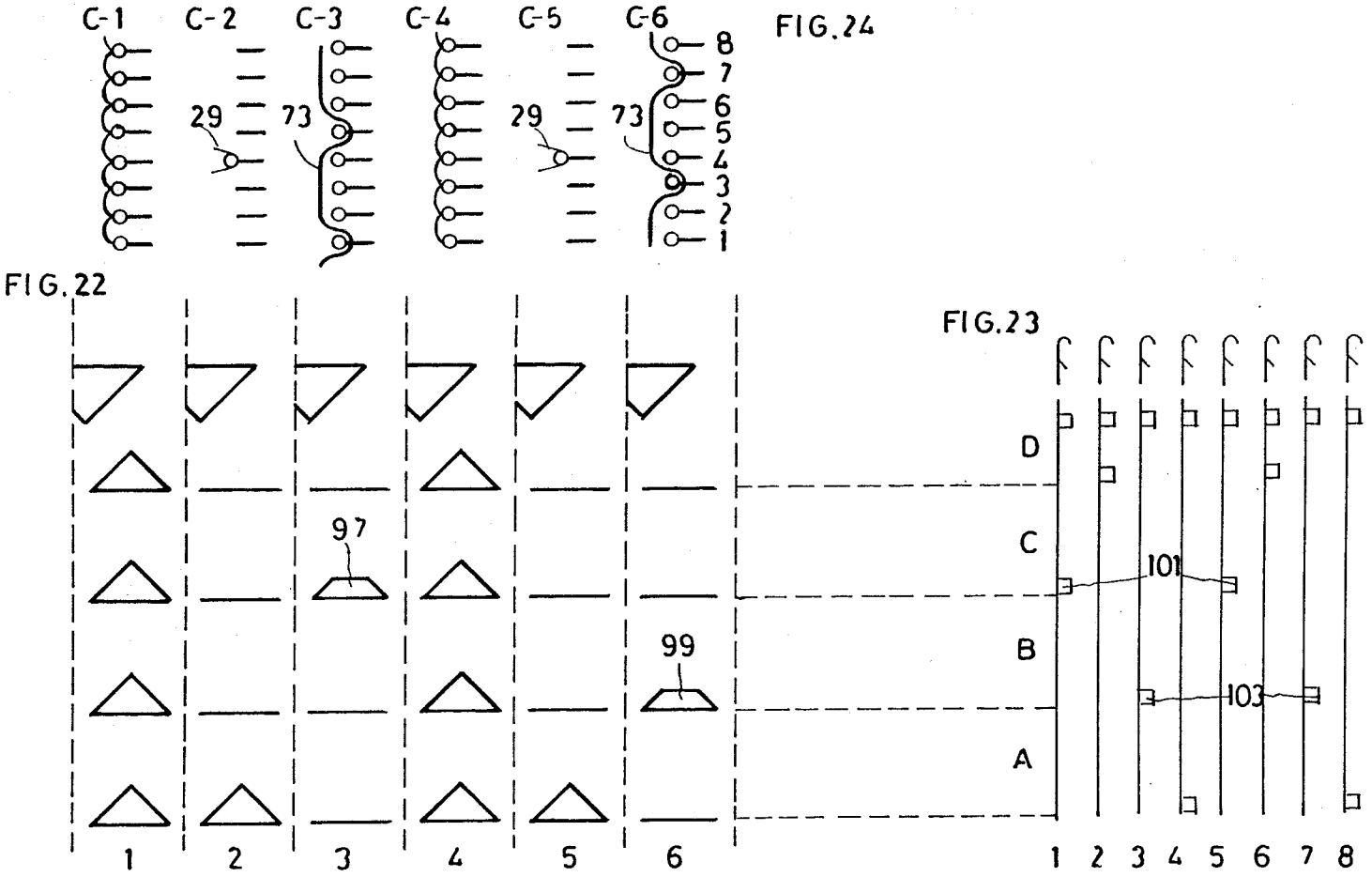
FIG. 22 is a further schematic representation of the camming system of two adjacent knitting cycles to combine fleece and wrap effects in the same fabric construction in the knitting machine during practice of the present invention.
FIG. 23 is a schematic representation illustrating the butt placements on knitting needles that may be used in cooperation with the camming system of FIG. 22.
FIG. 24 is a schematic representation of the successive fabric courses produced when the camming means of FIG. 22 are used in combination with the butt arrangement of the knitting needles of FIG. 23.

FIGS. 22, 23 and 24 are ilustrative of the cam/needle butt arrangement when a lay-in yarn 73 is introduced at feeds 3 and 6. It will be noted that cams 97 and 99, at feeds 3 and 6 respectively, raise needles 101 and 103 at their respective levels to a tuck height to receive the lay-in yarns 73 at feeds 3 and 6.

FIG. 25 schematically illustrates a complete knitting cycle comprising three successive feeds. At feed 1, a jersey course is formed on all needles; at feed 2, selected needles 4, 5 and 6 are raised to a knit level to receive a wrap yarn 29; at feed 3, all needles except needles 4, 5 and 6, which received the wrap yarn at feed 2, are raised to a knit level to receive a ground yarn.

In the above description of the preferred embodiments, it was noted that the wrap yarn was introduced into the hooks of needles selectively actuated to a knit level. This was accomplished by means of raising cams 91 of feeds 2 and 5 as shown in FIG. 19. In this instance, the wrap yarn is subsequently drawn into a knitted loop which appears on the technical face of the fabric. It will be understood that if tuck cams—as for example cams 97 and 99 of FIG. 22—had been used in place of raising cams 91 of FIG. 19, then the needle receiving the wrap yarn would have been selected to a tuck height. Consequently, the wrap yarn would have been introduced in a non-knit manner and would have appeared on the technical backside of the fabric in a substantially walewise direction. This method of introducing a wrap yarn would complement the lay-in yarn since both yarns would then be introduced into the fabric in a non-knit manner and would both appear on the technical backside of the knitted fabric. This technique may be effectively employed in those knitted constructions where heavy effect or decorative yarns are incorporated on the technical backside of the knitted fabric.

What is claimed is:

1. A circular knitting machine comprising:
(a) a plurality of needles:
(b) a cylinder slotted to receive said plurality of needles:
(c) means for actuating said plurality of needles:
(d) yarn wrapper assembly means for introducing yarn into the hooks of selected needles, said wrapper assembly means including a first member adapted for radial movement relative to the cylinder, and a second, rotatable member pivotably mounted to said first member for rotatable movement relative thereto and having yarn feeding means at an outer extremity thereon; and
(e) synchronized camming means, having dual, continuous and unbroken cam raceways integral in a common camplate member, for independently actuating said first and second members and for imparting cooperative movements thereto throughout substantially the full extents thereof, whereby superimposing the radial movement of the first member with the rotatable movement of the second member an individual yarn is introduced into the hooks of selected needles.

2. A circular knitting machine comprising:
(a) a plurality of needles:
(b) a cylinder with vertical slots to receive said plurality of needles moveable with respect to said slots;
(c) means for actuating said plurality of needles;
(d) a dial member mounted inwardly of said cylinder and including a plurality of radial slots;
(e) yarn wrapper assembly means for introducing yarn into the hooks of needles selectively raised to a yarn receiving level, said wrapper assembly means including a first membre slidable in a a cooperating radial slot of said dial member for radial movement relative to the cylinder, and a second rotatable member pivotably mounted to said first member for rotatable movement relative thereto and having yarn feeding means at an outer extremity thereon; and
(f) independent and dual closed track camming means integral in a common camplate member and in synchronized cooperation for actuating said first and second members and for imparting cooperative movements thereto throughout substantially the full extents thereof, whereby an individual yarn is introduced into the hooks of the selectively raised needles.

3. The machine of claim 2, wherein said dual camming means includes a first camming system for independently actuating said first slidable member between inner and outer radial positions and a second camming system for independently actuating said second rotatable member between different rotatable positions, the camming systems having continous unbroken cam surface formed in said common camplate member; wherein said first member comprises an elongated member having (i) a rectangular cross-section, (ii) smooth wall surfaces for slidable engagement with wall surfaces of said cooperating radial slot of said dial member, (iii) a downwardly-extending cam follower member for cooperating with said continuous unbroken cam surface of said first camming system thereby actuating said first slidable member between said inward and outward radial positions, and (iv) a slot formed at the forward end for receiving and pivotally mounting said second rotatable member for rotational movement; and wherein said second member comprises an elongated member having (i) a downwardly-extending cam follower member lying in substantially the same plane as the cam follower member of said first slidable member for cooperating with the continuous unbroken cam surface of said second camming system thereby imparting a rotational movement to said second member, and (ii) a downwardly-extending yarn tube member of said yarn feeding means.

4. The machine of claim 2, wherein said camming means are so positioned and synchronized with respect to each other to impart a non-circular, arcuate path to the yarn feeding means of said second rotatable member.

5. The machine of claim 2, further comprising first projection means associated with said first slidable member and second projection means on said second rotatable member, and wherein said independent dual camming means includes first unbroken cam raceway means cooperating with said first projection means associated with said first slidable member for independently actuating said first slidable member between inner and outer radial positions, and a second unbroken cam raceway means, synchronized with said first cam raceway system and cooperating with said second projection means on said second rotatable member for independently actuating said second rotatable member through different rotatable positions, whereby an individual yarn is introduced into the hooks of the selectively raised needles.

6. The machine of claim 5, wherein said first projection means associated with said first slidable member and said second projection means associated with said second rotatable means are in continously unbroken sliding engagement with their respective cooperating cam raceway means throughout the full extents of their synchronized movements, whereby an individual yarn is introduced into the hooks of the selectively raised needles.

7. The machine of claim 6, wherein said individual yarn, introduces into the hooks of the selectively raised needles, defines a complete non-circular arcuate path.

8. A circular knitting machine comprising:
(a) a plurality of needles;
(b) a cylinder with vertical slots to receive said plurality of needles moveable with respect to said slots;
(c) means for actuating said pluarlity of needles;
(d) a dial member mounted inwardly of said cylinder and including a plurality of radial slots;
(e) yarn wrapper assembly means for introducing yarn into the hooks of needles selectively raised to a yarn receiving level, said wrapper assembly means including a first member slidable in a cooperating radial slot of said dial member for radial movement relative to the cylinder, and a second rotatable member pivotably mounted to said first member for rotatable movement relative thereto and having yarn feeding means at an outer extremity thereon; and (f) synchronized camming means, having independent inner and outer cam raceways operative in a camplate member mounted inwardly of the plurality of needles, for actuating said first and second members, said cam raceways being continous and unbroken throughout the full extents thereof so the cooperative movements are imparted to said first and second members, whereby an individual yarn is introduced by said yarn feeding means into the hooks of the selectively raised needles in a closed loop, unbroken non-circular arcuate path.

9. The machine of claim 8, wherein said camming means includes a first camming system incorporating the inner cam raceway for independently actuating said first slidable member between inner and outer radial positions and a second camming system incorporating the outer cam raceway for independently actuating said second rotatable member between different rotatable positions; wherein said first member comprises an elongated member having (i) a rectanagular cross-section, (ii) smooth wall survaces for slidable engagement with wall surfaces of said cooperating radial slot of said dial member, (iii) a downwardly-extending cam follower member for cooperating with said inner cam raceway of said first camming system thereby actuating said first slidable member between said inward and outward radial positions, and (iv) a slot formed at the forward end for receiving and pivotally mounting said second rotatable member for rotational movement; and wherein said second member comprises an elongated member having (i) a downwardly-extending cam follower member lying in substantially the same plane as the cam follower member of said first slidable member for cooperating with said outer raceway cam of said second camming system thereby imparting a rotational movement to said second member, and (ii) a downwardly-extending yarn tube member of said yarn feeding means.

10. The machine of claim 8, wherein the non-circular arcuate path defines the movement of said yarn feeding means commencing from a starting position inwardly of the needles, continuing in the arcuate path inwardly of the needles, cutting across the circle of needles, then moving through an arcuate path outwardly of the needles, introducing the yarn into the hooks of the selectively raised and then again cutting across the circle of needles back to the starting position, thereby introducing the wrap yarn into the hooks of selectively raised needles.

11. The machine of claim 8, wherein said yarn feeding means comprises a downwardly-extending yarn tube member for guiding yarn into the hooks of the selected needles.

12. The machine of claim 10, wherein said camming means are so positioned and synchronized with respect to each other to impart movement to the yarn feeding means of said second rotatable member, whereby the length of the non-circular, arcuate path is minimized.

13. A circular knitting machine comprising:

(a) a plurality of needles:

(b) a cylinder with vertical slots to receive said plurality of needles moveable with respect to said slots;

(c) means for actuating said plurality of needles;

(d) a dial member mounted inwardly of said cylinder and including a plurality of radial slots;

(e) a yarn wrapper assembly means for introducing yarn into the hooks of needles slectively raised to a yarn receiving level, said wrapping assembly means including a first member slidable in a cooperating radial slot of said dial member between inner and outer radial positions for radial movements relative to the cylinder, and a second rotatable member pivotably mounted to said first member for movement between different rotatable relative thereto and having yarn feeding means in an outer extremity thereon; and (f) synchronized independent dual am raceway means jointly operative in a camplate member mounted inwardly of the plurality of needles for actuating said first and second members, said dual cam raceway means having continous unbroken camming surfaces throughout their operative extents to impart cooperative movements to said first and second members, a first of said cam raceway means actuating said first slidable member between said inner and outer radial positions and a second of said cam raceway means actuating said second rotatable member between said different rotatable positions, whereby an individual yarn is introduced by said yarn feeding means into the hooks of the selectively raised needles in a non-circular arcuate path commencing from a start position inwardly of the needles, continuing in the arcuate path inwardly of the needles, cutting across the needles, then moving through an arcuate path outwardly of the needles, and then again cutting across the needles back to the start position, thereby introducing the wrap yarn into the hooks of the selectively raised needles.

14. The machine of claim 13, wherein said dual cam raceway means are so positioned and synchronized with respect to each other to impart movement to the yarn feeding means of said second rotatable member, whereby the length of the non-circular, arcuate path is minimized.

15. The machine of claim 13, wherein said first member comprises an elongated member having (i) a rectangular cross-section, (ii) smooth wall surfaces for slidable engagement with wall surfaces of said cooperating radial slot of said dial member, (iii) a downwardly-extending cam follower member for cooperating with said continous unbroken camming surface of said first cam raceway means thereby actuating said first slidable membr between said inward and outward radial positions, and (iv) a slot formed at the forward end for receiving and pivotally mounting said second rotatable member for rotational movement; and wherein said second member comprises an elongated member having (i) a downwardly-extending cam follower member lying in substantially the same plane as the cam follower member of said first slidable member for cooperating with the continous unbroken cam surface of said second cam raceway means thereby imparting a rotational movement to said second member, and (ii) a downwardly-extending yarn tube member of said yarn feeding means.

16. The machine of claim 14, wherein said dial member having said plurality of radial slots is rotatable, said machine further comprises a stationary second dial member having an inner cam raceway comprising said first cam raceway means and an outer cam raceway comprising said second cam raceway means, and wherein said first slidable member has a downwardly extending cam follower member for cooperating with said inner cam raceway and the second rotatable member has a cam follower member cooperating with said outer cam raceway.

17. The machine of claim 16, wherein each of the cam raceways has a portion away from the outer edge of the stationary dial member such that when the cam follower members are in the corresponding portions of the cam raceway the yarn wrapper assembly means of these cam follower member members remains inoperative.

18. The machine of claim 15, wherein said elongated member of said second rotatable member is generally L-shaped having arms of unequal length, the downwardly extending cam follower member being substantially ar the end of the short arm of the L-shaped elongated member, the yarn tube member being located substantially at the end of the long arm of the L-shaped elongated member, the long arm having a sloping center portion and a hole in the apex of the L-shaped member, and wherein a pin is provided for insertion into said hole for rotatably attaching said elongated member to said first, slidable member.

19. The machine of claim 18, wherein said elongated member of said first slidable member has a lateral flange for additional support of said shorter arm of said second, rotatable member.

* * * * *